United States Patent [19]

Hayes

[11] Patent Number: 4,651,905

[45] Date of Patent: Mar. 24, 1987

[54] DISPENSER PACKAGE

[75] Inventor: Thomas H. Hayes, Lancaster, Ohio

[73] Assignee: Anchor Hocking Corporation, Lancaster, Ohio

[21] Appl. No.: 748,869

[22] Filed: Jun. 26, 1985

[51] Int. Cl.[4] ..... B65D 83/14

[52] U.S. Cl. ..... 222/394; 222/490; 222/505; 222/515; 251/96

[58] Field of Search ..... 222/402.13, 387, 389, 222/490, 515, 511, 567, 476, 505, 549, 394; 401/262, 260; 251/96, 100, 215, 227

[56] References Cited

U.S. PATENT DOCUMENTS

| | | | |
|---|---|---|---|
| 823,932 | 6/1906 | Corcoran | 222/567 X |
| 1,553,113 | 9/1925 | Rutt | 222/511 X |
| 3,007,614 | 11/1961 | Morrow | 222/490 X |
| 3,161,325 | 12/1964 | Hinkel et al. | 222/490 X |
| 3,336,603 | 8/1967 | Leland | 222/505 X |
| 3,458,263 | 7/1969 | Gibbs | 222/567 X |
| 3,459,342 | 8/1969 | Manning | 222/402.13 |
| 3,780,694 | 12/1973 | Wilbur | 222/402.13 X |
| 3,797,704 | 3/1974 | Dykes | 222/515 X |
| 3,981,597 | 9/1976 | Cohn | 222/402.13 X |
| 4,232,748 | 11/1980 | Thoma | 251/96 X |
| 4,271,991 | 6/1981 | Diamond | 222/387 X |
| 4,420,097 | 12/1983 | Motsenbocker | 222/511 X |

FOREIGN PATENT DOCUMENTS

| | | | |
|---|---|---|---|
| 194555 | 4/1957 | Austria | 222/505 |

*Primary Examiner*—Joseph J. Rolla
*Assistant Examiner*—Nils Pedersen
*Attorney, Agent, or Firm*—Stoll, Wilkie, Previto and Hoffman

[57] ABSTRACT

A dispensing package is described for toothpaste or similar products. The package has a product chamber which is filled with the product and a propellant and has a valve operated nozzle including a reed-type outlet in which operation of a valve button causes the product to flow outwardly through the normally closed reed opening. The nozzle including the reed-type outlet is molded plastic of generally conical form adapted to fit over the product and propellant container.

9 Claims, 11 Drawing Figures

1
2
3
4
5
6
7
8
9
10
11
12
13
14
26
27
28
29
30
31

DISPENSER PACKAGE

BACKGROUND OF THE INVENTION

The present invention relates to convenience packaging and more particularly to an aerosol or propellant type package for toothpaste or similar products where the user dispenses a limited amount of product by pressing a button on a package nozzle. More particularly, the invention is an improved dispenser of toothpaste or the like which provides a simplified plastic nozzle and nozzle control arrangement in an aerosol type package.

There are a number of dispensing packages including mechanical or aerosol packages where the product is dispensed by mechanical action or by the pressure of a gas propellant such as freon or other propellant gases. Such containers have a variety of pressure and nozzle control devices, however, the prior ones are not well adapted to toothpaste dispensing as they are complex and difficult to control particularly as regards the dispensing of small amounts of toothpaste or other product.

The dispenser of the present invention provides a conveniently used and easily manufactured and attractive dispensing package.

Accordingly, an object of the present invention is to provide an improved aerosol-type dispenser for toothpaste and similar products.

Another object of the present invention is to provide an easily controlled aerosol-type toothpaste dispenser.

Another object of the present invention is to provide an attractive aerosol-type toothpaste dispenser.

Another object of the present invention is to provide an easily manufactured and relatively inexpensive plastic dispenser.

Other and further objects of the present invention will become apparent upon an understanding of the illustrative embodiments about to be described, or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a perspective view of a preferred embodiment of the dispenser.

FIG. 2 is a side elevational view partially in section of the package of FIG. 1.

FIGS. 9 through 10 are enlarged fragmentary sectional views of the reed nozzle in its closed and opened posision respectively.

FIG. 11 is a fragmentary view of another embodiment of a package in accordance with the invention.

DESCRIPTION OF THE PREFERRED EMBODIMENT

Figures 1, 2, 8, 10, 11:
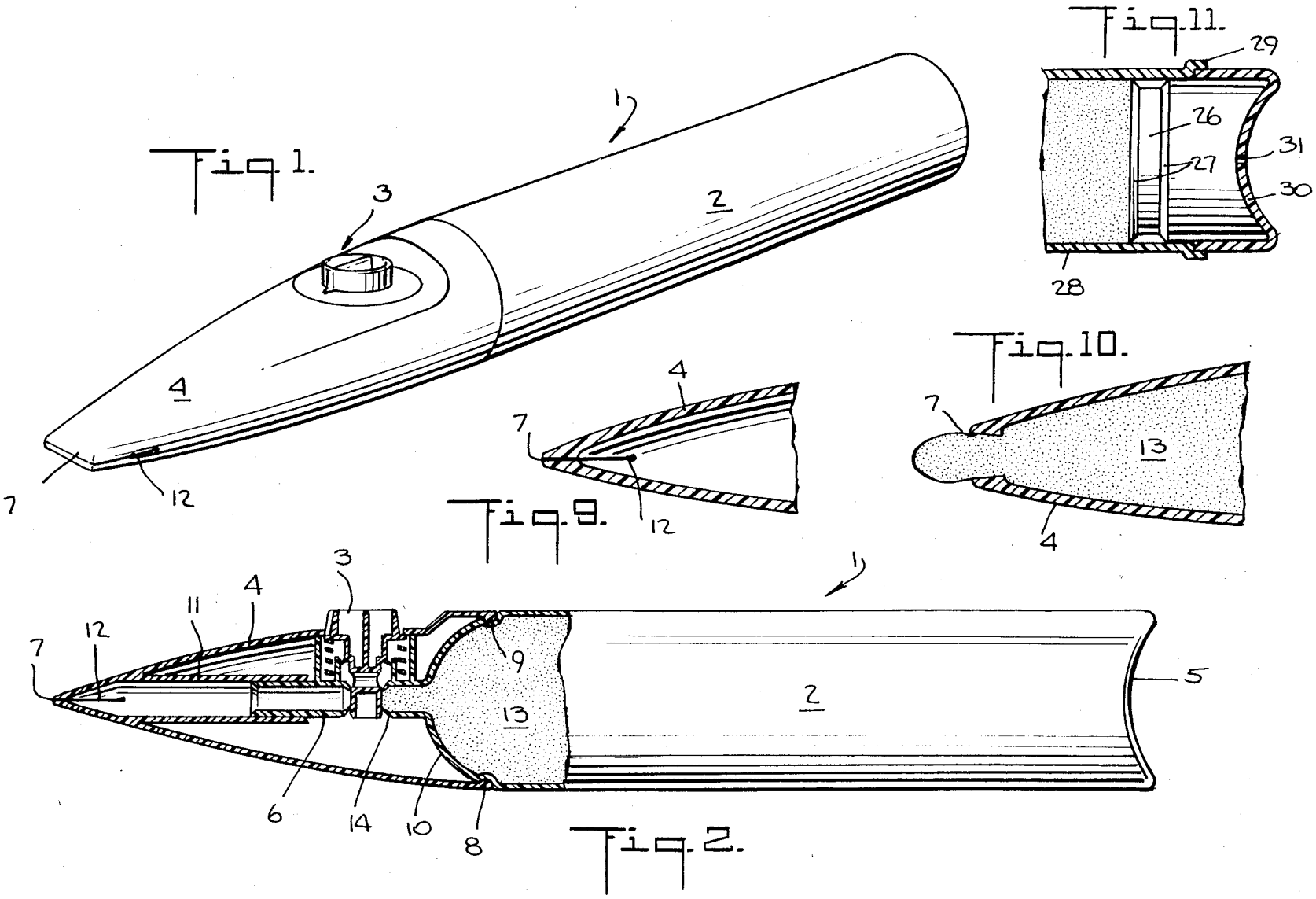

The drawing illustrates a preferred embodiment of the dispenser 1. There are three principal portions of the dispenser 1 which are the product and propellant container 2, the valve 3, and the dispensing nozzle and housing 4. Preferably the container 2 comprises a molded plastic container having a convenient shape of generally cylindrical form with a concave bottom 5 and an outlet 6 at its domed top 10.

The valve 3 and dispensing nozzle housing 4 are preferably molded plastic. The housing 4 has a reed-type dispensing opening 7 at its narrow end and has a bead 8 at its opposite end for engagement with a groove 9 on the container 2. The bead 8 on the housing 4 is shaped to engage the cooperating groove 9 on the upper portion of the container 2. The housing 4 may be snap fitted to the aerosol container 2 with or without additional cementing or other attaching means.

The preferred dispensing opening is a reed valve type of opening 7 which eliminates the need for an additional cover during the package use. The opening 7, as illustrated, has a generally cylindrical feed nozzle 11 coupled to the aerosol container outlet 6. The outer or dispensing opening 7 tapers to a point and has a slit 12 extending longitudinally and laterally for feeding the toothpaste or other dispensed material as it opens under pressure. The pressure from the propellant forces the material 13 outwardly through the valve 3 and outlet 6 and causes the opening 7 to spread outwardly or open to release the toothpaste or other product for use as illustrated in FIG. 10.

The valve structure 3, as illustrated, is a separate assembly and also is preferably formed of plastic and adapted for being attached to the dispensing cone 4 and the container outlet 6 in position to control the flow of material 13 from the aerosol container 2. The aerosol container 2 outlet 6 is tightly fitted to the inner end of the feed nozzle 11. A valve opening 14 is formed in outlet 6 to receive a valve stem 16.

Figure 4:
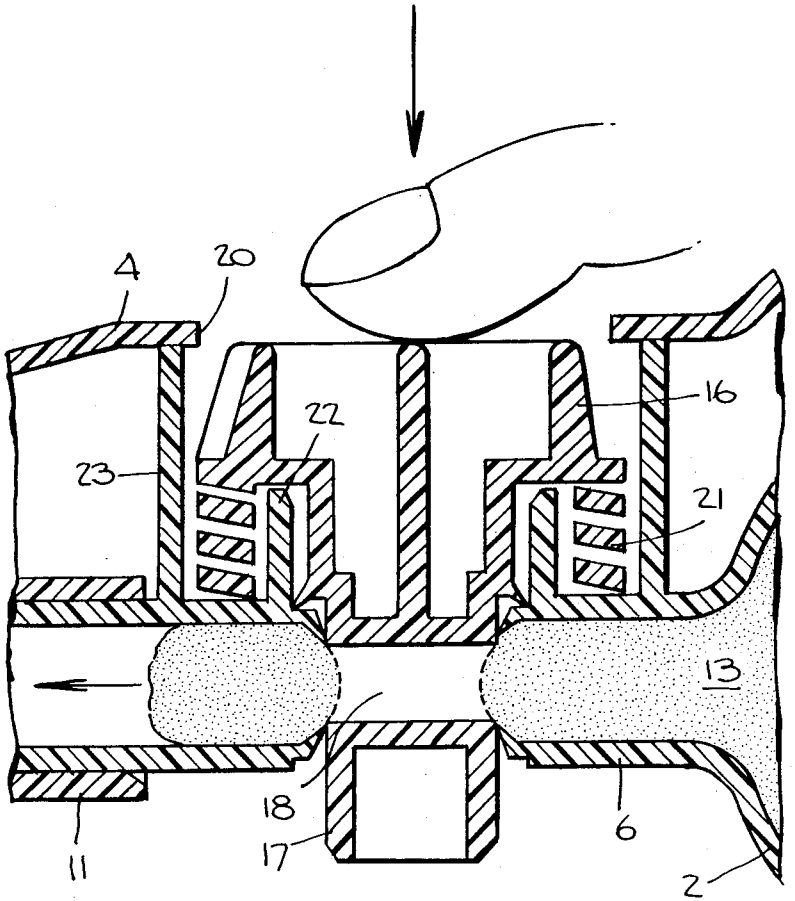
FIGS. 3 and 4 are enlarged fragmentary cross-sectional views of the valve assembly in its closed and open positions respectively.
Figure 3:
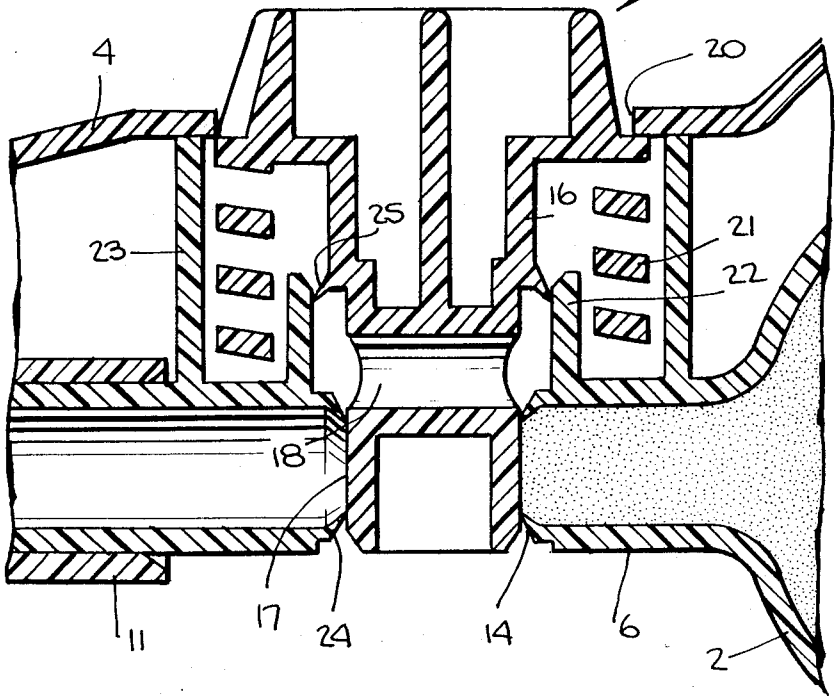

The control valve 3 has the stem 16 mounted for rotational and axial movement with respect to the container outlet 6. The end of the stem 16 has a cylindrical sealing portion 17 (FIG. 3) which closes off the outlet 6 when the valve stem 16 is in its outer and closed position (FIG. 3). A port 18 is formed in the stem 16 (FIGS. 3 and 4) inwardly of the sealing portion 17 for passing product when the valve stem 16 is rotated and depressed to the open position illustrated in FIG. 4. It is also possible to close the outlet 6 with the stem 16 in its depressed position by rotating the stem 16 90° causing the solid portion of the stem 16 to close off the opening 6 as illustrated in FIG. 8.

Figure 5:
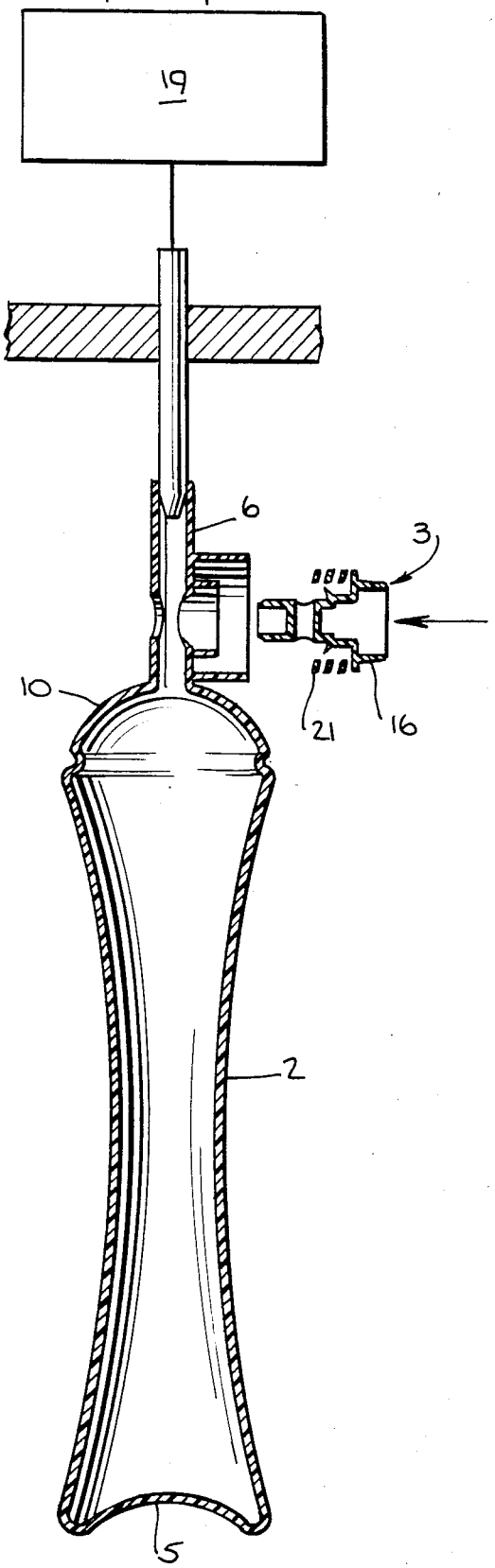
FIGS. 5 through 8 are sectional views illustrating container filling and related valve manipulation.
Figure 6:
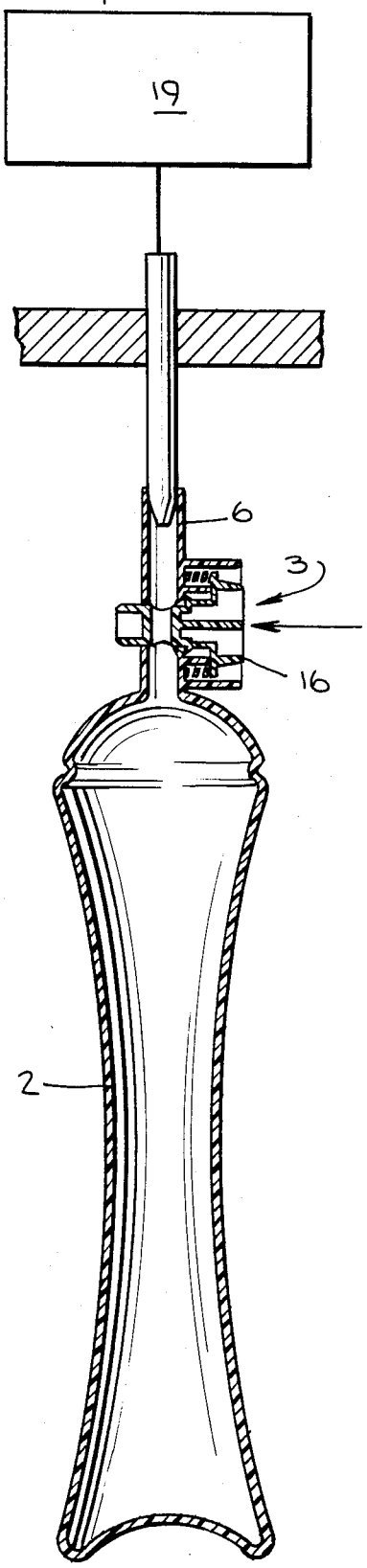
Figure 7:
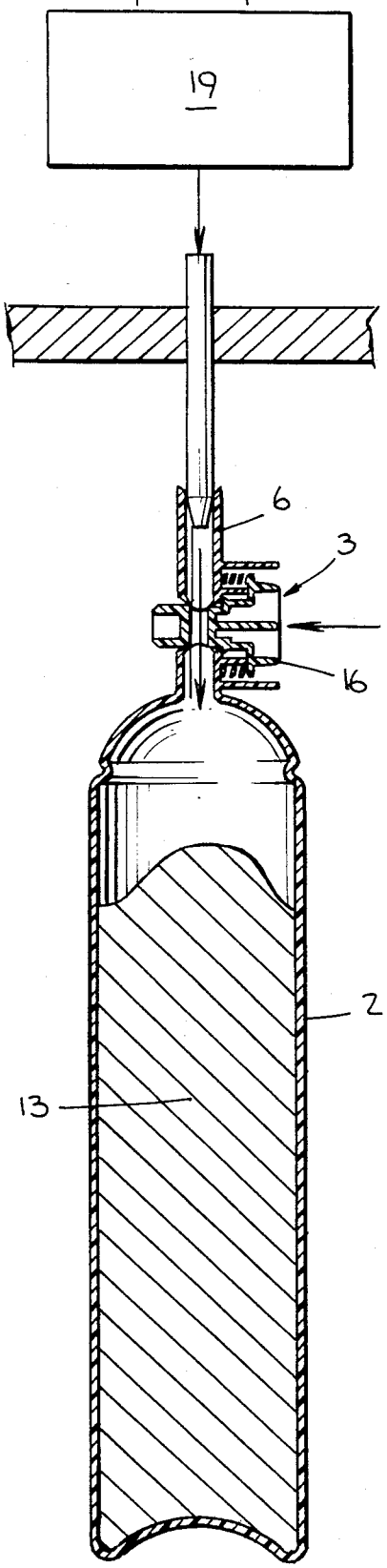
Figure 8:
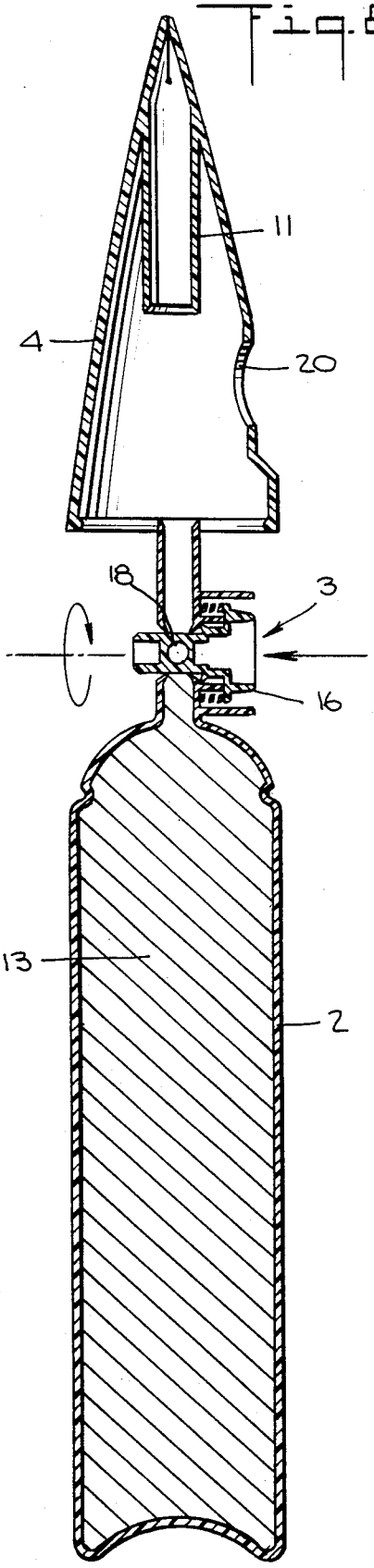

This permits the stem 16 to be used as a product release in a push-pull manner which is closed when the stem 16 is out and is open when the stem 16 has been pressed in. It also permits the stem 16 to close off the outlet 6 in its depressed position by the above described 90° rotation. Closing the container 2 with stem 16 depressed is useful during the filling of the container 2 and the attachment of the housing 4 to the filled container 2. As illustrated to FIGS. 5 through 7, the container 2 may be attached to an aerosol and product filling means indicated generally at 19 and the container 2 filled with the stem 16 depressed while turned to its open position as illustrated in FIGS. 6 and 7. Thereafter, as illustrated in FIG. 8, the stem 16 may be rotated 90° to a closed position while still depressed permitting the housing 4 to be slipped over valve 3 and locked into place on the container 2 with the aperture 20 in the housing 4 passing over the depressed stem 16. Thereafter, the completed package 1 may be returned to a normal dispensing postion by rotating the stem 16 90° and permitting it to return to its normal out and off position (FIG. 3).

The stem 16 of the control valve 3 is normally held in its outer and closed position by a spring means 21 surrounding the inner end of the stem 16 and confined between the stem 16 and adjacent flanges 22 and 23 at the outlet 6. The spring means 21 may be a metallic spring or may be a plastic spring formed separately or formed as an integral portion of the molded container 2 or housing 4.

In order to provide a seal at the valve 3, integrally molded flexible seals 24 are formed at the aperture 14 in the outlet 6. A secondary seal 25 is similarly molded integrally with the inner end of stem 16. The valve 3 is illustrated in its closed position in FIG. 3 and in its open position in FIG. 4 with the material 13 passing through the valve stem aperture 18.

As described above, the dispenser 1 utilizes a propellant supplied in the container 2 behind the package for expelling the material when the valve 3 is opened. For certain materials including those which may not be compatible with the chosen propellant, it is desirable to isolate the packaged material from the propellant by providing a piston within the container between the material and the propellant.

Such a piston 26 is illustrated in the embodiment of the dispenser illustrated in FIG. 11. The piston 26 may be a molded plastic piston including one or more flexible sealing gaskets at its circumference. One form of seal is illustrated comprising integrally molded flexible sealing seals 27 provided at the outer top and bottom edges of the piston 26. In order to position the piston 26 within the container 28, the container 28 will be formed with an initial split or division. A seam or division 29 may be formed at any point throughout the cylindrical portion of the container 28 to permit insertion of the piston 26 and the container 28 may be welded or cemented or otherwise sealed after the piston is inserted. When such a piston is used, provision is made for inserting the propellant behind the piston and this is conveniently done by providing a closable pin hole 31 in the bottom 30 of the container 28.

It will be seen that an improved pressurized dispensing package for products such as toothpaste has been provided which is convenient and reliable to use and easily formed by molding operations.

As various changes may be made in the form, construction and arrangement of the invention and without departing from the spirit and scope of the invention, and without sacrificing any of its advantages, it is to be understood that all matter herein is to be interpreted as illustrative and not in a limiting sense.

Having thus described my invention, I claim:

1. An improved pressurized dispensing package comprising the combination of:

a container for containing a product and a propellant and having an outlet at its top, a hollow housing for the container outlet including an opening at an outer end with a coupling communicating with said container outlet, a valve mounted at and controlling said container outlet including a stem mounted for rotary and axial movement with respect to said outlet, a port in said stem positioned for opening the valve in its axially innermost position, sealing surfaces on said valve stem for closing the valve when the stem is in its axially outermost position, and said stem having sealing surfaces adjacent to said port for closing the valve upon rotation of the axially depressed stem.

2. The dispensing package as claimed in claim 1 in which the opening in said housing is an expandible slit.

3. The dispensing package as claimed in claim 1 in which the opening in said housing is a reed-type opening.

4. The dispensing package as claimed in claim 1 in which said container comprises molded plastic.

5. The dispensing package as claimed in claim 1 in which said housing comprises molded plastic.

6. The dispensing package as claimed in claim 1 in which said valve stem comprises molded plastic.

7. An improved pressure dispensing package comprising the combination of a molded plastic container for containing a product and a propellant and having a tubular outlet at its top, a hollow molded plastic housing for said container outlet including an opening at one end with a coupling connecting said opening with said container outlet, a valve aperture in said housing, means attaching said housing to the top of said container, a valve in said container outlet including a stem mounted for rotary and for an in and out axial movement with respect to said container outlet, a port in said stem for opening the valve when said stem is in its axially inner position, and sealing surfaces on said valve stem adjacent to said port for closing it at the axially inner position of said stem and additional sealing surfaces for closing it at the axially outer position of said stem.

8. The dispensing package as claimed in claim 7 in which the housing opening is an expandible slit.

9. An improved aerosol dispensing package comprising the combination of a molded plastic container for containing a product and a propellant and having an outlet at its top, a hollow molded plastic cover for said container including a pressure expandible opening at one end with a coupling communicating with said container outlet, and a valve in said outlet including a stem mounted for axial movement between open and closed positions, said valve stem formed to provide both an open and a closed position in its axially innermost position and a closed position only in its axially outermost position.

* * * * *